US006705981B2

(12) United States Patent
Bergeron et al.

(10) Patent No.: US 6,705,981 B2
(45) Date of Patent: Mar. 16, 2004

(54) DEVICE FOR RETENTION OF PRODUCTS ON A TRANSPORTING SURFACE IN A FOLDER

(75) Inventors: Eugene John Bergeron, Barrington, NH (US); Barry Mark Jackson, York, ME (US); David Elliot Whitten, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 3 days.

(21) Appl. No.: 09/492,903

(22) Filed: Jan. 27, 2000

(65) Prior Publication Data

US 2002/0147092 A1 Oct. 10, 2002

(51) Int. Cl.[7] ..... B31B 1/14

(52) U.S. Cl. ..... 493/370; 493/227; 493/241; 493/359; 83/339

(58) Field of Search ..... 493/227, 241, 493/324, 370, 359; 83/339, 649, 949

(56) References Cited

U.S. PATENT DOCUMENTS

| | | | | |
|---|---|---|---|---|
| 880,465 | A | * | 2/1908 | Price |
| 1,782,674 | A | * | 11/1930 | Baumgartner |
| 1,900,288 | A | | 3/1933 | Jordhoy |
| 2,031,780 | A | | 2/1936 | Lamatsch |
| 2,499,570 | A | * | 3/1950 | Crafts ..... 164/68 |
| 3,188,084 | A | | 6/1965 | Raybuck |
| 3,521,512 | A | | 7/1970 | Woessner |
| 3,999,454 | A | | 12/1976 | Tiso et al. |
| 4,368,879 | A | * | 1/1983 | Hoshi ..... 270/6 |
| 4,445,881 | A | | 5/1984 | Bullen et al. |
| 4,465,269 | A | * | 8/1984 | Petersen ..... 270/47 |
| 4,601,693 | A | | 7/1986 | Richey |
| 4,765,604 | A | | 8/1988 | Trogan |
| 4,917,665 | A | | 4/1990 | Couturier |
| 4,957,280 | A | * | 9/1990 | Motooka ..... 270/47 |
| 5,000,729 | A | | 3/1991 | Yamauchi |
| 5,004,451 | A | * | 4/1991 | Prum ..... 493/359 |
| 5,024,128 | A | * | 6/1991 | Campbell, Jr. ..... 83/26 |
| 5,029,128 | A | | 7/1991 | Toda |
| 5,122,109 | A | | 6/1992 | Kubota et al. |
| 5,312,032 | A | * | 5/1994 | Rautenberg et al. ..... 225/100 |
| 5,405,126 | A | * | 4/1995 | Mack ..... 270/6 |
| 5,520,378 | A | * | 5/1996 | Kepert et al. ..... 270/8 |
| 5,622,113 | A | | 4/1997 | Hansen |
| 5,755,654 | A | | 5/1998 | Schulz et al. |
| 5,806,392 | A | * | 9/1998 | Cleall et al. ..... 83/155 |
| 5,921,906 | A | * | 7/1999 | Nagano ..... 493/370 |
| 6,093,139 | A | | 7/2000 | Belanger ..... 493/353 |
| 6,159,138 | A | | 12/2000 | Lanvin et al. ..... 493/359 |
| 6,179,764 | B1 | * | 1/2001 | Eckert ..... 493/356 |

FOREIGN PATENT DOCUMENTS

| | | |
|---|---|---|
| DE | 19853415 | 7/1999 |
| DE | 10060713 | 9/2001 |
| EP | 0931747 | 7/1999 |

* cited by examiner

*Primary Examiner*—Eugene Kim
*Assistant Examiner*—Christopher Harmon
(74) *Attorney, Agent, or Firm*—Davidson, Davidson & Kappel, LLC

(57) ABSTRACT

The present invention is related to a device for seizing flat material (1). The device includes a transfer cylinder (6) rotating about an axis and having an outer surface (16). A cutting cylinder (3) cooperates with said transfer cylinder (6) and has at least one knife assembly (5) mounted thereon. A set of product seizing elements (7) is arranged in the outer periphery of said cutting cylinder (3), actuable about a common center point (11). Tips (25) of said product seizing elements (7) cooperate with counterparts (9) on the surface (16) of said transfer cylinder (6).

15 Claims, 5 Drawing Sheets

DEVICE FOR RETENTION OF PRODUCTS ON A TRANSPORTING SURFACE IN A FOLDER

FIELD OF THE INVENTION

The present invention is related to a device for a retention of products on a transporting surface in a folder, particularly for web-fed rotary printing presses.

BACKGROUND OF THE INVENTION

U.S. Pat. No. 2,031,780 is related to a rotary cutting and folding mechanism for printing machines. In this solution pins are disclosed, carried by one of the folding cylinders to temporarily hold the leading edge of the web or the sheets. According to this disclosure retractable pin elements are assigned to a cutting knife arranged on a cutting cylinder and corresponding anvil bars are assigned to a folding cylinder. Said pin elements are arranged as to penetrate an incoming web of material or a sheet to be seized on a respective transporting cylinder's surface. A product rim being penetrated by punched holes of said pin elements is subject to further trimming operations when finishing the respective folded products and nowadays primarily is acceptable by the customer only on newspapers.

U.S. Pat. No. 1,900,288 discloses a folding cylinder to the surface of which a plurality of anvil bars is assigned. Similar to the disclosure according to U.S. Pat. No. 2,031,780 previously described, retractable pin elements are assigned to each of said anvil bars. Said anvil bars cooperate with knives received on the circumference of a cutting cylinder. Said pin elements are mounted within the interior of said folding cylinder. Similar to the disclosure according to U.S. Pat. No. 2,031,780 said retractably mounted pin elements penetrate said products to be conveyed on the surface of the respective folding cylinder.

U.S. Pat. No. 4,445,881 is related to a method and apparatus for improving newspaper folding and cutting mechanisms. The improvement is related to folding newspapers in the collecting mode. Inside and outside web sections are printed with the same number of lines and transferred to a folding cylinder which collects them in an overlapping relation. Expanding means incorporated in the body of the cylinder expand its effective radius to permit the trailing edge of the outside section to be cut to a length equal to that of the inside section without recutting the inside section again. The collected sections are then passed through second fold rollers for final folding.

U.S. Pat. No. 5,122,109 concerns a folding drum in a folding apparatus for a rotary printing press. Tips of folding blades project to the outside of the folding drum through gaps between the respective blades. At least two bands are integrally connected by a respective band mount position with a plurality of groups of such integrally connected bands being provided. Each band mount position is mounted to the folding drum via respective adjusting devices such that the expansion of the bands of each group of the folding drum can be adjusted. Preferably each adjusting device includes an adjusting plate engaged with an adjusting rack to which the bands are mounted and an adjusting shaft. The adjusting plate is mounted to the adjusting shaft at an eccentric position with respect to its engagement with the adjusting rack.

In known folders according to the state of the art, a set of cutting cylinders is included to create the signatures which are then forwarded into an accelerator section made of strips of transferring material such as tapes, to give an example.

Several methods are employed to prevent the signatures from opening after it has been severed from a web of material and forwarded into respective sets of tapes. At high speeds the forces acting on the book are too large and render most of these methods ineffective.

Other methods include cutting a portion of signature in the cutting cylinders' area, then performing the final cut in a second pair of cutting cylinders or directly on a pinless transfer cylinder.

SUMMARY OF THE INVENTION

Accordingly, it is an object of the present invention to prevent respective leading edges of web of materials from opening up during a transitory period after the previous signature has been severed from the web of material.

A still further object of the present invention is to introduce a respective leading edge of a web of material into a set of tapes accurately, the respective sets of tapes assigned to a further cylinder of a respective folder apparatus.

According to the invention, a device for seizing flat material comprises:

a transfer cylinder rotating about an axis and having an outer surface, a cutting cylinder cooperating with said transfer cylinder, said cutting cylinder having at least one knife mounted thereon, and a set of product seizing elements arranged on the outer periphery of said cutting cylinder actuatable about a common center point, tips of said product seizing elements cooperating with counterparts on the surface of said transfer cylinder.

The advantages of the present invention are to be seen in that the leading edge of webs of material is under positive control upon a respective transitory period after the respective previous signature has been cut from said web of material. Thus, an opening up of the respective leading edge is prevented. An opening of the respective leading edge of the web of material would result in an inaccurate insertion or the occurrence of dog ears of the respective leading edge upon transfer of said leading edge into a respective sets of tapes after the transitory period. The accuracy of product transfer during the respective transitory period determines the accuracy of folding operations during the respective signature's transport through the folder apparatus.

In further embodiments of the present invention said product seizing elements are arranged on the surface of a cutting cylinder and actuated when a respective new leading edge travels upon the respective circumference of a transfer cylinder. To allow for seizing the entire leading edge of the respective web of material, said product seizing elements may be arranged spaced apart from each other, extending over the entire width of the respective cutting cylinder. To allow for a relative movement of said product seizing elements said product seizing elements being shaped as finger elements are rotatably mounted in brackets. Said brackets are to be arranged in a simple and easy manner on the respective face portions of the cutting cylinder for example. To allow for simultaneous movement of the respective product seizing elements when actuated said seizing elements are arranged on a common axis.

Said common axis is journalled in respective levers which are rotatably mounted about center points to allow for a seizing movement of said product seizing elements. Said seizing movement occurs when a respective dwell sections of a cam element assigned to said cutting cylinder actuates a cam follower mounted to said lever which is mounted pivotably about the previously mentioned center point.

The seizing movement of the tips of the respective seizing elements is initialized when a previously cut signature from the leading edge of the web of material is created. Then, said tips of said product seizing elements engage said newly created leading edge positioned above a respective counterpart for a cutting operation. To allow for a supported but still flexible seizing operation, said leading edge of a web of material is positioned above an anvil bar received in respective grooves on the surface of said transfer cylinder, the anvil bars having a rather elongated shape to enlarge said leading edges seizing zone.

Said product seizing elements are preferably mounted to respective product conducting cylinders or pinless folders assigned to respective web-fed rotary printing presses for commercial and newspaper printing.

BRIEF DESCRIPTION OF THE DRAWINGS

The novel features which are considered as characteristic for the invention are set forth in particular in the appended claims. The invention itself, however, both to its construction and its method of operation together with additional objects and advantages thereof, will be best understood from the following description of a specific embodiment, when read in connection with the accompanying drawings, in which:

DESCRIPTION OF THE PREFERRED EMBODIMENTS

Figure 1:
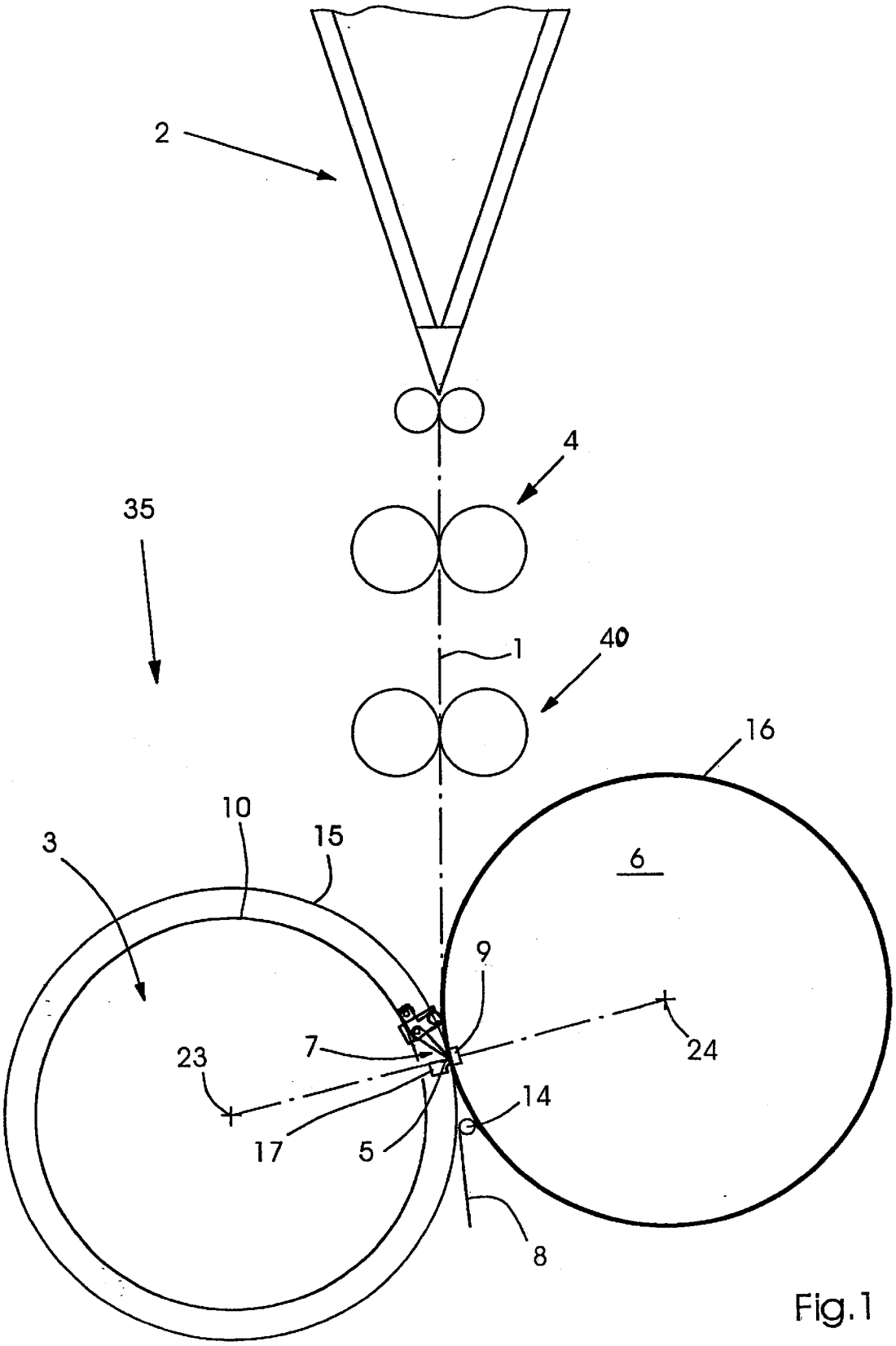
FIG. 1 is a schematically given view of a web travel path into the cutting nip between two cooperating cylinders of a folder assembly.

In FIG. 1 a schematically side elevation of a web travel path into the cutting nip between two cooperating cylinders in a folder assembly is given.

In this configuration of a folder assembly 35, a former board 2 is arranged prior to respective pair of nip rollers 4, which receive a longitudinally folded web of material 1. The respective web of material 1 could as well be received from said pair of nip rollers 4 without being longitudinally folded by said former board 2 previously arranged. After passing of a second pair of nip rollers 40 said web of material 1 is received within a nip between a cutting cylinder 3 having an outer surface 15 and a transfer cylinder 6 having an outer surface 16, respectively. Said cutting cylinder 3 rotates about an axis 23, whereas said transfer cylinder 6 is rotating about an axis 24, respectively. Below a transfer area within which said web of material 1 is transferred to a respective transfer cylinder's 6 surface 16 a set of tapes 8 is arranged, into which the respective products severed from the respective leading edge will be inserted. In a fixed position with a center point concentric to the first cylinder 3 a cam element 10 is mounted which serves for an actuating purpose of product seizing elements 7 given in greater detail in FIGS. 2*a*, 2*b*, respectively. To said surface 15 of the cutting cylinder 3 at least one knife 5 is assigned, cooperating with respective counterparts 9 assigned to the surface 16 of said transfer cylinder 6. Said at least one knife 5 on the circumference of the cutting cylinder 3 is received in a knife box 17 for easier exchange and fixing thereof. Said sets of tapes 8 capturing the respective leading edge of the web of material 1 after the transitory period rotate about pulleys 14, one of which is only schematically given here.

Figure 2A:
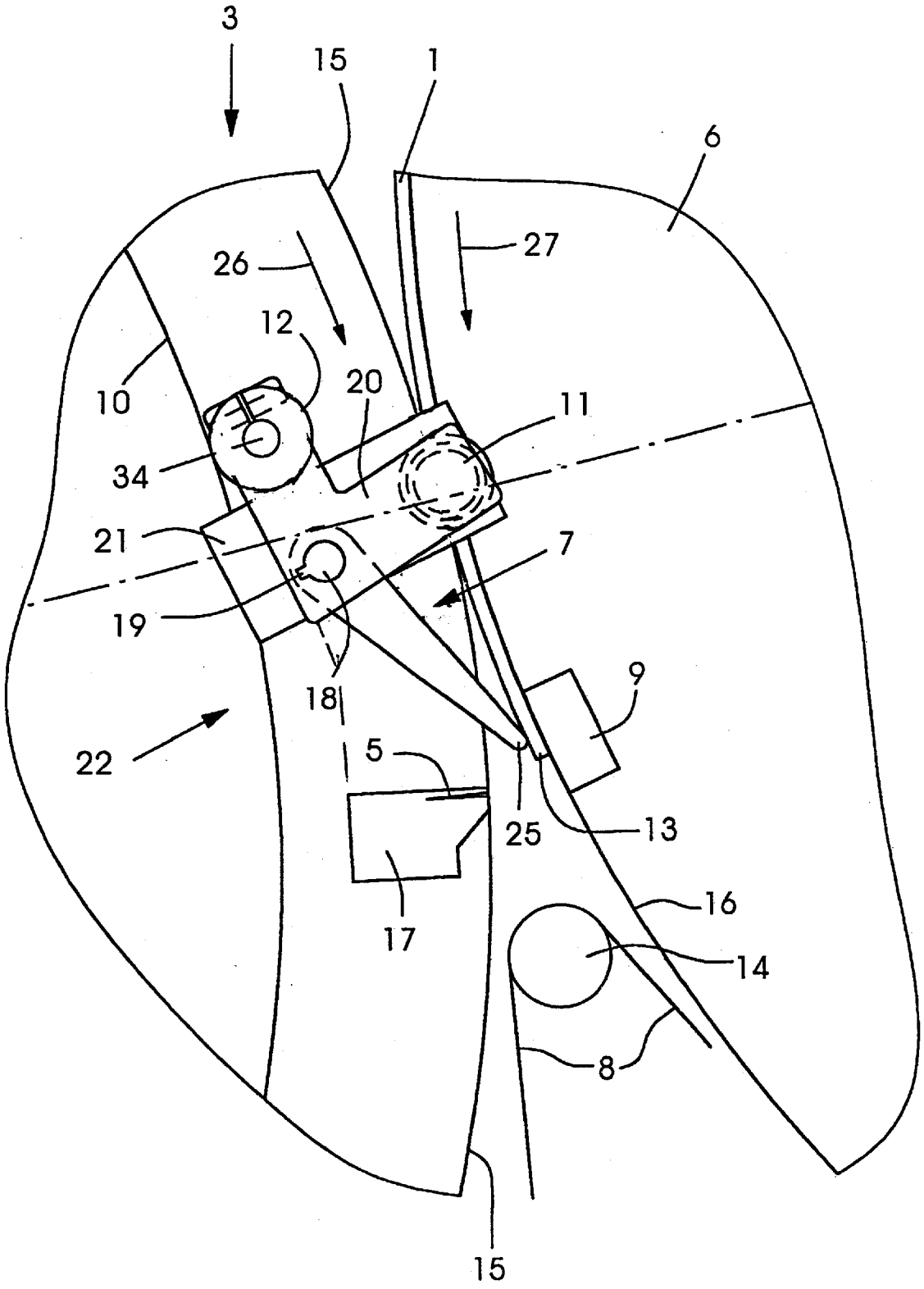
FIG. 2*a* shows product seizing elements seizing a respective leading edge of a web of material prior of insertion into a belt entry.

FIG. 2*a* shows product seizing elements seizing a respective leading edge of a web of material supported by a respective counterpart prior to the set of tapes.

FIG. 2*a* shows said transfer cylinder 6 to be rotated in a sense of rotation 27 given by the arrow in the vicinity of the transfer cylinder's surface 16. The respective leading edge section 13 of a web of material 1 supported by said surface 16 of the transfer cylinder 6. The cutting edge of said leading edge 13 is located above a cutting counterpart 9, for example an anvil bar, having a substantially rectangular shape. Said anvil bar is received in a groove of said transfer cylinder 6. The rectangular shape of said counterpart 9 provides for a larger product seizing zone on the respective surface 16 of the transfer cylinder due to the enhanced length circumferential direction of said counterpart 9.

The respective cooperating cylinder 3, for instance a cutting cylinder comprises an outer surface 15. Into said outer surface 15 of said cutting cylinder 3 a plurality of knife boxes 17 are received, each knife box having a respective knife 5. Both cylinders, i.e. cutting cylinder 3 and transfer cylinder 6 are faced such that counterparts 9 and said knives 5 assigned to the respective cylinder when cooperating which each other sever a respective signature from the respective leading edge 13 of the web of material 1. To the outer periphery of said cutting cylinder 3 an actuating element 10 is assigned of which only a portion is shown here. The outer periphery of said cutting cylinder 3 further comprises bracket elements 21 of which only one is given in the embodiment according to FIG. 2*a*. In said bracket elements 21 levers 20 are rotatably mounted about a center point 11 given in dashed lines in the embodiment according to FIG. 1. Said lever elements 20 comprise a set of product seizing elements 7, which are located in a gap 15*a* in cylinder surface 15, gap 15*a* being shown schematically by dashed lines and in more detail in FIG. 3. Said product seizing elements 7 assigned to said lever 20 are longitudinally extended finger-shaped elements having a tip 25 and provided for cooperation upon actuation with said leading edge 13 of the web of material 1 supported by said counterparts 9 on the surface 16 of said transfer cylinder 6. Said product seizing elements 7 being received within a lever 20 are arranged on a common axis 18 extending over the entire width of said paper conducting cylinder such as a cutting cylinder 3. To secure the seizing movement with respect to the leading edge 13 of the web of material 1 said set of seizing elements is keyed by a key 19 within said lever 20. The movement of said lever 20 about said center point 11 is actuated by an actuating element 12 such as a cam follower, cooperating with the respective surface of said cam element 10 assigned to one face of said cutting cylinder 3. Said lever 20 rotatably received about said center point 11 may be spring biased for actuation and is actuated by respective high and low dwell portions of said cam element 10, when cooperating with said cam follower 12. Said cutting cylinder 3 substantially rotates in a sense of rotation indicated by reference numeral 26 assigned to the respective arrow.

Figure 2B:
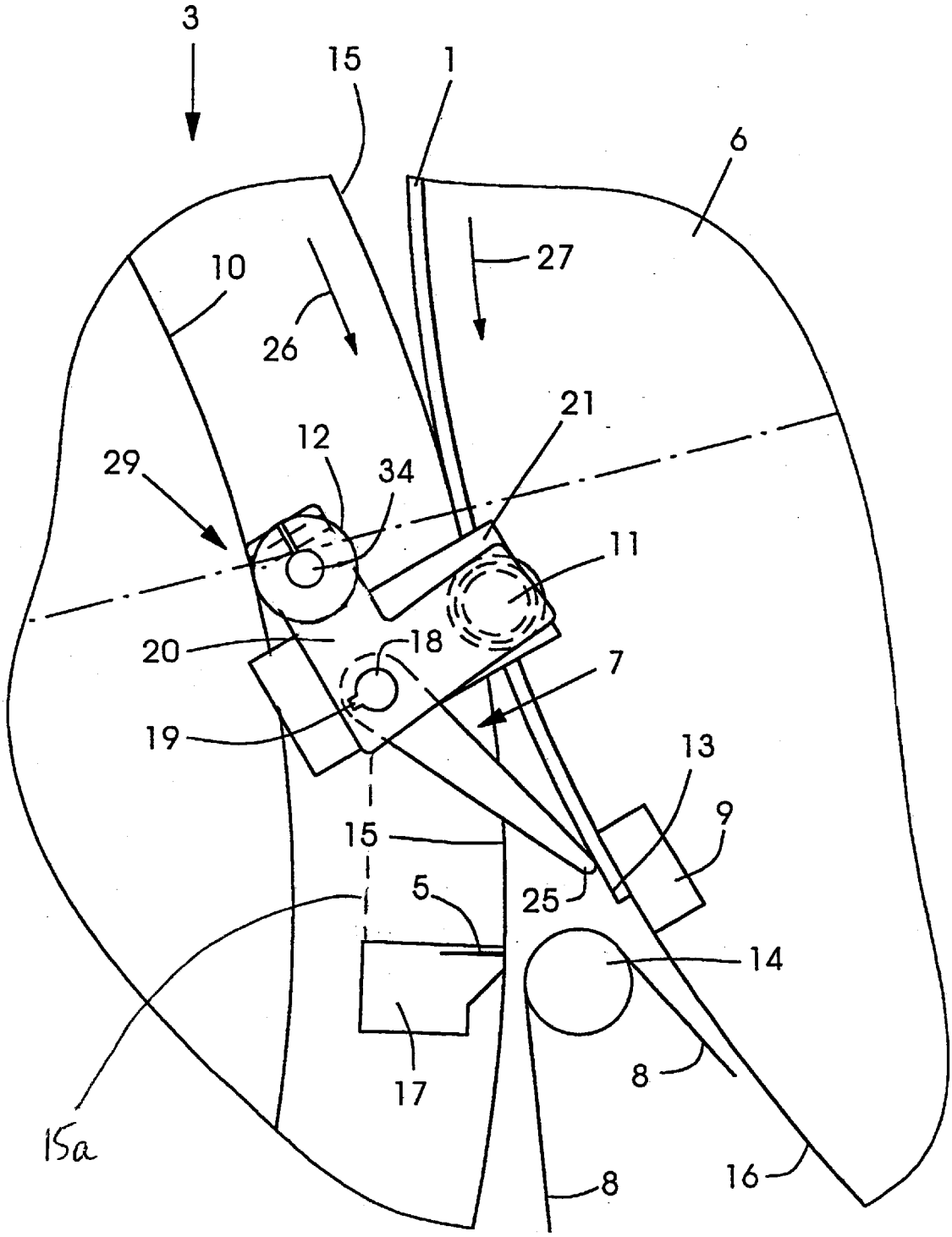
FIG. 2*b* shows a respective leading edge of a web of material prior to its release by said product seizing elements

FIG. 2*b* shows a respective leading edge 13 of a web of material 1 prior to release by said product seizing elements 7 assigned to said cutting cylinder 3.

In this stage of rotation of said paper conducting cylinders 3, 6, respectively, said leading edge 13 received on the surface 16 of said transfer cylinder 6 has moved upon rotation of said cylinders into the respective senses of rotation 26, 27, respectively, towards the entry section of said sets of tapes 8 rotating about pulleys 14. As can be derived from the configuration according to FIG. 2*b* said levers 20 receiving said cam follower 12 have been actuated via the surface of the cam element 10 assigned to said cutting cylinder 3 rotating the respective sets of tapes to seize the respective leading edge 13 received above the counterpart 9. Thus, during the transitory period after a previously severed signature has been inserted into the sense of tapes 8 positive control is exerted upon the respective leading edge and prevents the respective leading edge 13 of the web of material 1 from opening up. The facing of the actuating movement of said levers 20 receiving said product seizing elements 7 about the center point 11 is faced such that upon common rotation of said cylinders 3, 6, respectively, said product seizing elements' 7 tips 25 are maintained in continuous contact with the respective leading edge 13 of the web of material 1. Thus, upon common rotation of the product seizing elements 7 engaging the respective leading edge 13 of the web of material 1 the lever 20 actuated via cam follower 12 cooperating with cam elements 10 adopts an inclined position 29 shown in FIG. 2*b*.

The respective cam followers 12 which are used for an actuating element of said levers 20 about said center point 11 are mounted on respective cam follower axis 34 in cooperation with said cam element 10, the cam follower 12 actuates said lever 20 about its respective center point 11 to control the position of product seizing elements 7 relative to the transfer cylinder's 6 surface 16. The actuation of the product seizing elements' tips is such that the finger-shaped product seizing elements 7 continue to hold the leading edge 13 of the web of material 1 onto the surface 16 of the respective transfer cylinder 6. The facing is maintained until said respective product leading edge 13 is captured by the sets of tapes 8 rotating about pulleys 14. After the sets of tapes 8 have received the respective leading edge which is later on severed from the web of material 1 by a cutting operation of a further knife 5 and a further counterpart 9 on the respective cylinders 3 and 6, respectively, the fingers are free to move away from the respective transfer cylinder's surface 16 and rotate around the cutting cylinder 3 for a next seizing movement of a newly created respective leading edge.

To the respective surface 15 of a cutting cylinder a plurality of product seizing elements 7 can be assigned, preferably in the vicinity of respective knife assemblies 5 which are received in knife boxes 17, for instance. The number of knife assemblies 5 on the surface of the respective cutting cylinder 3 determines the number of cutting counterparts 9 being received in respective grooves on the surface of said transfer cylinder 6.

Figure 3:
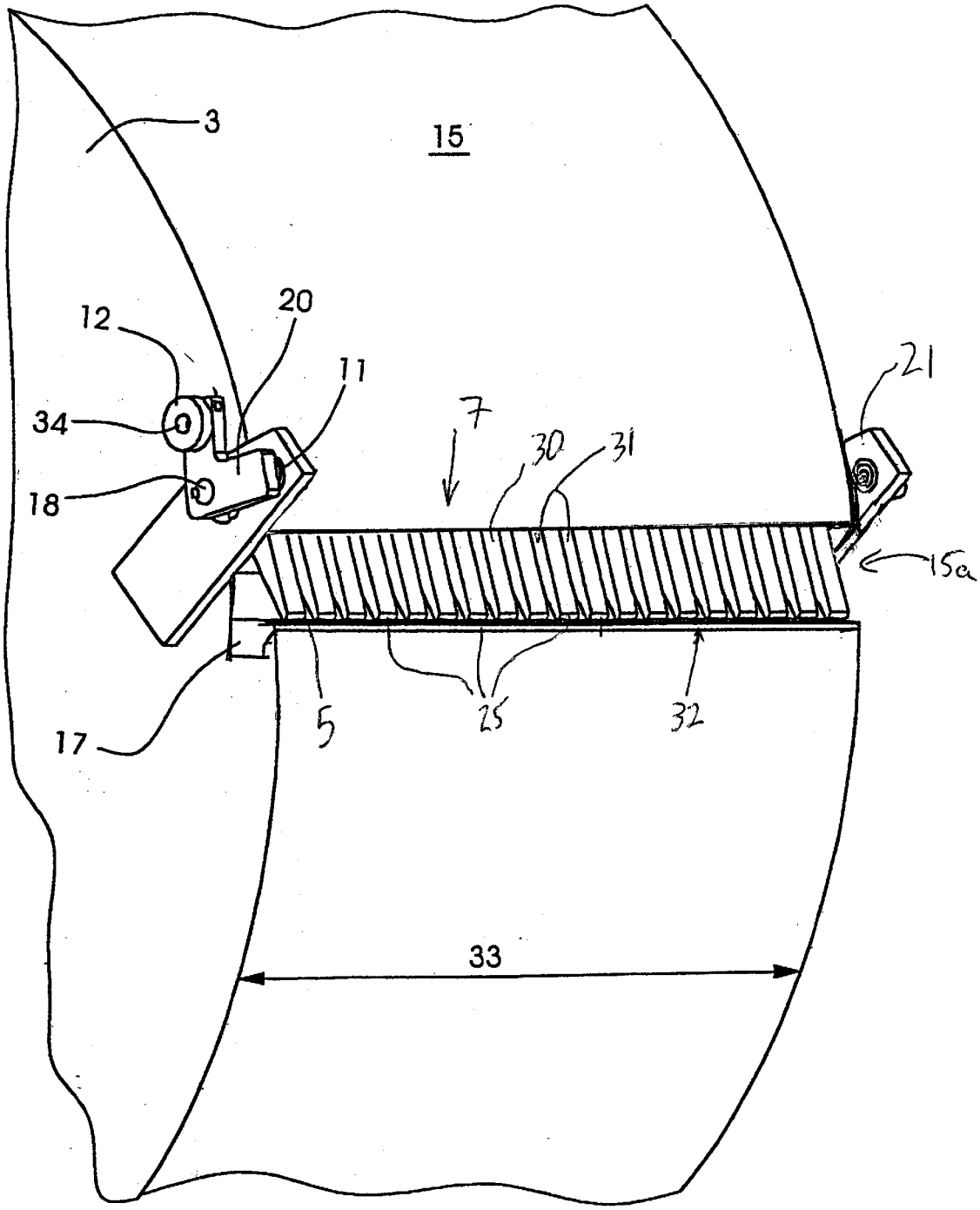
FIG. 3 shows a perspective view of a respective arrangement of product seizing elements extending over the width of a paper conducting cylinder such as a cutting cylinder and FIG. 4 shows a perspective view of a respective arrangement of product seizing elements which fit within a paper conducting cylinder such as a cutting cylinder.

FIG. 3 shows a perspective view of a respective arrangement of product seizing elements extending over the width of a cutting cylinder.

Said cutting cylinder 3 given in a partial view here comprises two face elements to which brackets 21 are assigned. Said brackets receive said actuatable levers 20 in center points 11 said levers being actuated by actuating elements 12 such as given as cam followers. Said cam followers 12 are received in respective axis 34 on said lever elements 20 having a substantially L-shaped configuration. Said levers 20 assigned to the brackets arranged on both faces of the cutting cylinder 3 further comprise a common axis of rotation 18. On said axis of rotation 18, which is beneath surface 15, said finger-shaped product seizing elements 7 are arranged in a surface gap 15*a* spaced from one another by a spacing 31 over the entire width 33 of the cutting cylinder 3. The spacing 31 of the respective product seizing elements 7 over the entire width of said surface 15 of the cutting cylinder 3 provides for a simultaneously occurring seizing of the respective leading edge 13 of the web of material 1 to be processed. Further, the spacing 31 serves the purpose to provide a location for passage through the tape trollies or pulleys. In the configuration according to FIG. 3 said knife tips 32 of said knife elements 5 received in boxes 17 in the respective surface 15 of the cutting cylinder 3 are shown in greater detail. Said tips 25 of the respective product seizing elements 7 may comprise pads for having elastic properties to facilitate a smooth seizing action on the respective leading edge 13 of the web of material 1.

The cam motion can withdrawal the product seizing elements 7 into gap 15*a* as the elements 7 pass through the nip, and then extend the elements 15 beyond surface 15*a* as shown in FIGS. 2*a* and 2*b*. Besides a cam activated actuation of the respective product seizing elements 7 on cutting cylinder 3 a remote controlled activation of said seizing motion may be conceivable as well. To this end to the respective end portions of the common axis 18 to which the respective product seizing elements 7 are commonly mounted electrical actuators such as electric motors may be assigned, which are remote controlled and could be activated on a respective seizing action of a leading edge 13.

Figure 4:
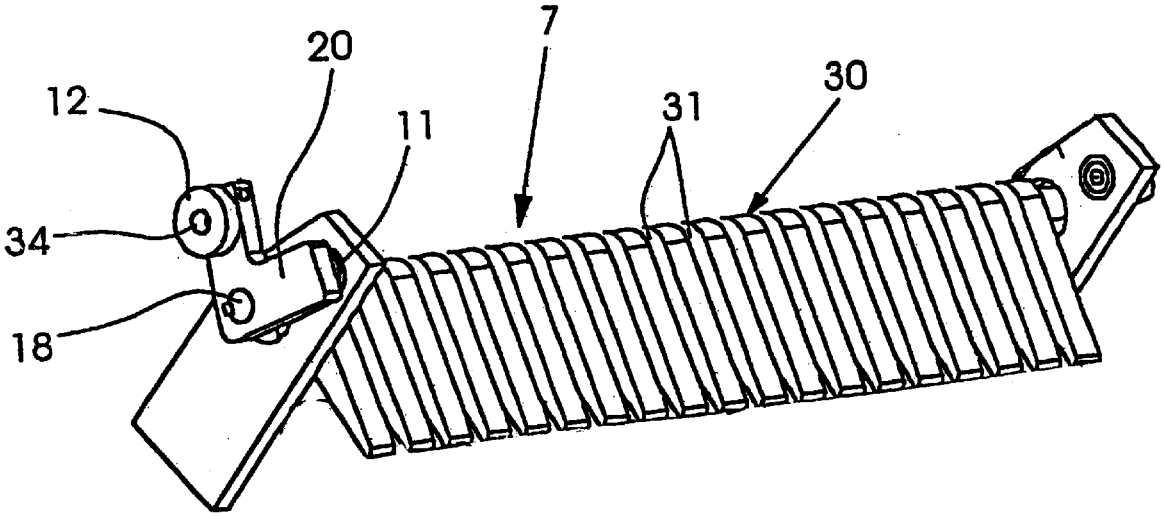

FIG. 4 shows the elements 7 and the support and actuating device for the fingers, removed from cylinder 3. The respective identification numbers are similar to those in FIG. 3.

Product seizing elements according to the present invention are preferably used in pinless folder assemblies 35 assigned to rotary printing presses for commercial and newspaper purposes.

| Reference Numeral List | |
|---|---|
| 1 | web of material |
| 2 | former board |
| 3 | cutting cylinder |
| 4 | pair of nips |
| 5 | knives |
| 6 | transfer cylinder |
| 7 | product seizing elements |
| 8 | set of tapes |
| 9 | cutting counterpart |
| 10 | cam |
| 11 | center point |
| 12 | cam follower |
| 13 | leading edge |
| 14 | pulleys |
| 15 | cutting cylinder surface |
| 15a | gap |
| 16 | transfer cylinder surface |
| 17 | knife box |
| 18 | axis |
| 19 | key |
| 20 | lever |
| 21 | bracket |
| 22 | cam dwell section |
| 23 | rotating axis cutting cylinder |
| 24 | rotating axis transfer cylinder |
| 25 | seizing element tip |
| 26 | sense of rotation |
| 27 | sense of rotation |
| 28 | cut |
| 29 | inclined lever position |

-continued

| Reference Numeral List | |
|---|---|
| 30 | lever mounting axis |
| 31 | spacing |
| 32 | knife tip |
| 33 | cylinder width |
| 34 | cam follower axis |
| 35 | folder assembly |
| 40 | nip rollers |

What is claimed is:

1. A device for seizing flat material comprising:

a former board for folding the flat material;

a transfer cylinder rotating about an axis and having an outer circumferential surface;

a cutting cylinder cooperating with said transfer cylinder and having at least one knife mounted thereon and for cutting the flat material downstream of the former board; and a set of product seizing elements arranged in an outer periphery of the cuffing cylinder and actuable about a common center point, the product seizing elements having edges, the edges cooperating with the outer circumferential surface of the transfer cylinder so as to hold a leading edge of the flat material against the outer circumferential surface, the product seizing elements including a set of fingers spaced apart from each other by spacings; and a set of tapes, the tapes passing through the spacings of the fingers.

2. The device according to claim 1 wherein the product seizing elements are mounted to the cutting cylinder for cooperation with the outer surface of the transfer cylinder arranged adjacent to the cutting cylinder.

3. The device according to claim 1 wherein the product seizing elements are mounted on a common axis.

4. The device according to claim 3 wherein the common axis is journalled in levers arranged on face portions of the cutting cylinder.

5. The device according to claim 4 wherein the levers are mounted in brackets of the cutting cylinder for movement about center points.

6. The device according to claim 4 wherein the common axis is keyed to the levers.

7. The device according to claim 4 wherein the levers comprise a respective actuating element cooperating with an actuating element assigned to the cutting cylinder.

8. The device according to claim 1 wherein the product seizing elements are mounted in respective brackets arranged on cutting cylinder.

9. The device according to claim 1 further comprising counterparts to the at least one knife on the transfer cylinder and wherein a leading edge of a respective web of material is positioned above one of the cutting counterparts.

10. The device according to claim 9 wherein the cutting counterparts have an elongated shape forming pads, the edges of the product seizing elements moving toward the pads upon actuation.

11. The device according to claim 1 wherein an actuating element is assigned to a face portion of the cutting cylinder.

12. The device as recited in claim 1 wherein the transfer cylinder has an anvil bar at the outer circumferential surface, the at least one knife contacting the anvil bar.

13. The device as recited in claim 1 further comprising a set of tapes located between the transfer cylinder and cutting cylinder.

14. A device for seizing flat material comprising:

a transfer cylinder means for rotating about an axis and having an outer circumferential surface;

a cutting cylinder cooperating with said transfer cylinder and having at least one knife mounted thereon and for cutting the flat material downstream of the former means;

means for seizing a product arranged in an outer periphery of the cutting cylinder and actuable about a common center point, the products seizing means including product seizing elements having edges, the edges cooperating with the outer circumferential surface of the transfer cylinder so as to hold a leading edge of the flat material against the outer circumferential surface, the means for seizing a product including a set of fingers spaced apart by spacings; and a set of tapes located between the transfer cylinder and the cutting cylinder, the tapes passing through the spacings of the fingers.

15. A device for seizing flat material comprising:

a former board for folding a flat material;

a transfer cylinder rotating about an axis and having an outer surface and a counterpart at the outer surface, the counterpart being an anvil;

a cutting cylinder cooperating with said transfer cylinder and having at least one knife mounted thereon for cutting the flat material downstream of the former board; and at least one product seizing element arranged in an outer periphery of the cutting cylinder and actuable about a common center point, the product seizing element having an edge, the edge cooperating with the outer surface of the transfer cylinder and the at least one knife contacting the anvil to hold the flat material between the outer surface and the anvil, the at least one product seizing apparatus including a plurality of fingers spaced apart by spacings; and a set of tapes, the tapes passing through the spacings of the fingers.

* * * * *